United States Patent [19]

Leon Moyano

[11] 4,109,804

[45] Aug. 29, 1978

[54] VEHICLE PARKING SYSTEM WITH A PLURALITY OF MOVABLE COLUMS HAVING VEHICLE SUPPORTING FLOORS

[76] Inventor: Rafael Leon Moyano, Obispo Mardone, 78, Cordoba, Spain

[21] Appl. No.: 653,889

[22] Filed: Jan. 30, 1976

[30] Foreign Application Priority Data

Jan. 30, 1975 [ES] Spain ..... 434.295

[51] Int. Cl.[2] ..... E04H 6/06

[52] U.S. Cl. ..... 214/16.1 CB; 104/48

[58] Field of Search ..... 214/16.1 CB, 16.1 CC, 214/16.1 CD, 16.1 CE, 16.1 C, 16.1 R, 16.4 R, 16.4 A, 16.4 B, 16.4 C, 16 B; 104/48–49

[56] References Cited

U.S. PATENT DOCUMENTS

| | | | |
|---|---|---|---|
| 2,647,647 | 8/1953 | Alimanestiano | 214/16.1 CB |
| 2,670,859 | 3/1954 | Zeckendorf et al. | 214/16.1 CE |
| 3,148,785 | 9/1964 | Fauconnier | 214/16.1 CD |
| 3,390,791 | 7/1968 | Baldwin | 214/16.1 CC |
| 3,414,141 | 12/1968 | Rougemont | 214/16.1 CC |
| 3,417,879 | 12/1968 | Gough | 214/16 B |
| 3,557,973 | 1/1971 | Louviers et al. | 214/16 B |
| 3,800,963 | 4/1974 | Holland | 214/16.4 B X |
| 3,927,773 | 12/1975 | Bright | 214/16 B |
| 3,987,912 | 10/1976 | Moyano | 214/16.1 C |

FOREIGN PATENT DOCUMENTS

| | | | |
|---|---|---|---|
| 1,252,821 | 12/1960 | France | 214/16.1 EB |
| 1,070,366 | 12/1969 | Fed. Rep. of Germany | 214/16.1 CD |
| 1,163,584 | 2/1964 | Fed. Rep. of Germany | 214/16.1 R |
| 1,070,366 | 12/1959 | Fed. Rep. of Germany | 214/16.1 CD |
| 516,918 | 2/1955 | Italy | 214/16.4 A |
| 319,644 | 1/1970 | Sweden | 214/16.1 R |
| 887,823 | 1/1962 | United Kingdom | 214/16.1 CB |

*Primary Examiner*—Drayton E. Hoffman
*Assistant Examiner*—R. B. Johnson
*Attorney, Agent, or Firm*—Wenderoth, Lind & Ponack

[57] ABSTRACT

A vehicle parking system includes a parking area wherein the vehicle to be stored is deposited in a selected floor of a horizontally movable column. The columns are movable within the parking area by means of driving platforms which travel along the floor of the parking area or alternatively by bridge crane which travels along the ceiling of the parking area. A cargo hoist unit moves the vehicles vertically between the column floors and an entrance and exit area. A transfer carriage mounted on the cargo hoist unit transfers a vehicle between the cargo hoist unit and a column floor or the entrance and exit area.

9 Claims, 19 Drawing Figures

VEHICLE PARKING SYSTEM WITH A PLURALITY OF MOVABLE COLUMS HAVING VEHICLE SUPPORTING FLOORS

BACKGROUND AND SUMMARY OF THE INVENTION

The present invention relates to a modulated storage system, especially applicable to the parking of vehicles. The system of the invention can also be used as a container storage system. In any case, the object to be stored will be deposited, for an unpredictable period of time, in the interior of a movable column or tower structure having therein various superimposed floors.

Within the parking or storage area there are provided a plurality of such columns.

The columns can be moved along the length and width of a column storage area.

Each column may be differentiated from the remaining columns, for example by numerical references which may be used by an automatic control system.

The floors of each column may also be identified with regard to the column to which they pertain.

Movement of the columns within the interior of the column storage area is achieved by any one of two systems of the invention. One such system is an overhead bridge crane which suspends and transports the columns therefrom. The other system is a power carriage movable along the floor of the storage area and including a pair of superimposed self-driving platforms. One platform is movable in one direction along tracks or rails in the floor of the storage area, and the other platform is movable in a transverse direction along tracks in the floor and on the first platform, the other platform being movable under and lifting the column.

The movements of the bridge crane or power carraige may be controlled by electric pulses which operate electromotors which drive the bridge crane or power carriage.

The objects to be stored, such as vehicles to which reference will be made exclusively throughout the following specification, may be introduced into and withdrawn from the columns by electromechanical devices, also activated by electric pulses.

The vehicles which enter a parking lot will first pass to a cargo hoist which is vertically movable between various floor positions. The distance between two successive floor positions of the cargo hoist is the same as that which separates two successive floors of the columns.

When a vehicle is positioned within the cargo hoist, the cargo hoist is then vertically moved until it faces a floor of a column which is free. The vehicle is then transferred from the cargo hoist to such column floor. The column will then be transported to a particular storage zone within the column storage area.

It is possible for the column into which a vehicle has been transferred to await the receipt of another or other vehicles before it is transported to the storage zone.

Withdrawal of vehicles from the parking storage area of the lot is achieved by performing the above steps inverse to the described order.

Conventional vehicle parking systems usually consist of two buildings, one situated in front of the other, which are formed by a number of open vertically spaced cells in which vehicles are housed. These structures are absolutely immovable and their positions are never altered. Between the two blocks of cells there is provided a lifting installation that may be displaced both vertically and horizontally. This particular installation displaces the vehicles from an entry access to a cell and from the cell to an exit access. Thus, conventional systems include the feature that the vehicles are guided to the structure or assembly of immovable parking cells by means of a movable installation.

On the other hand, the parking system of the present invention is based on the concept that the structures which enclose the parking cells are movable and collect the vehicles at the entrance by means of a horizontally immovable installation. In other words, according to the invention the vehicle storage space is brought to the automobile rather than having the automobile brought to the storage space.

One of the greatest disadvantages of conventional mechanical parking systems resides in that such conventional systems have a reduced capability for withdrawing vehicles during those hours when there is the greatest demand for vehicles to leave the parking lot. This shortcoming has not as yet been solved by conventional parking systems. This is particularly troublesome in public parking lots holding a great number of vehicles, since the demand for a second automobile to leave the parking lot requires that the driver of such second vehicle must wait until the transportation unit has completed the withdrawal of the first vehicle. This results both in discontinuous flow of vehicles and a cumulative waiting period. This unpleasant situation is frequently faced by customers which demand their vehicles at a time coinciding with the closing of shops, department stores, cinemas, theatres, etc.

However, the parking system of the invention provides a solution to the above problem, and achieves a steady vehicle flow both during entrance and withdrawal of vehicles. This is due to the fact that the structures forming the groups of parking cells, i.e. the columns, are movable. The columns can be displaced independently and in a continuous manner, so that the time needed to perform plural vehicle movements is not cumulative but rather is simultaneous. In those hours when there is a great demand for withdrawal of vehicles from the parking lot, the system of the invention can make use of a suitable computerized program that will increase the efficiency of the installation, since a given structure or column containing a number of vehicles desired to be withdrawn may be transported to a withdrawal position by only one displacement thereof. This would be possible because the program control could select, based on the accumulated demand at rush hours, those columns containing the greatest number of the vehicles to be withdrawn and/or those columns closest to the exit access. Also, the provision of the vertical movement achieved by the cargo hoist unit and the separate and independent horizontal displacement of the columns allows both the vertical movement device and the horizontal movement device to operate simultaneously on plural vehicles. Similarly, in view of the fact that the lifting device has positions or levels at heights equal to those of the cells of the column, it is possible to move the lift to a desired level while a particular vehicle is being moved to the lift, and to also employ the time used for lifting for moving a vehicle to or from the lift. It is also possible to withdraw or to receive vehicles, one after the other, at the reception area, in a short period of time since the mere movement of the lift between adjacent levels thereof is sufficient to either withdraw or receive a further vehicle.

The installation used in known mechanical parking systems for carrying the vehicles usually includes a lift or cargo hoist unit including mechanical means for displacing the vehicles, unless this operation is carried out by operators, or alternatively such mechanical means are arranged in the respective parking cells. Such carriers used for carrying vehicles from the cell to the lift and from the lift to the exit access have inherent shortcomings arising from mechanical complexity and high cost. Additionally, conventional parking systems include the disadvantage of requiring an impractically large area.

Despite the long period of time which has elapsed since the recognition of the existence of parking problems in modern cities, and despite the appearance of mechanical parking systems, such parking systems have not reliably solved the above problems. The mechanical systems presently known fail to attain the desired or at least sufficiently satisfactory results necessary to displace the conventional ramp parking systems, which have continued to be employed in view of the poor results achieved by presently known mechanical parking systems.

The mechanical parking system of the present invention however offers the improvement that it does not require expensive foundations which are necessary in conventional parking systems. Furthermore, the great mechanical simplicity of the present system causes the cost thereof to be at least 30% less than that of parking systems utilizing ramps, and also much less than that of known mechanical parking systems.

BRIEF DESCRIPTION OF THE DRAWINGS

One embodiment of a vehicle parking system according to the present invetion will now be described in detail below, with reference to the attached drawings, wherein.

DETAILED DESCRIPTION OF THE INVENTION

Figure 1:
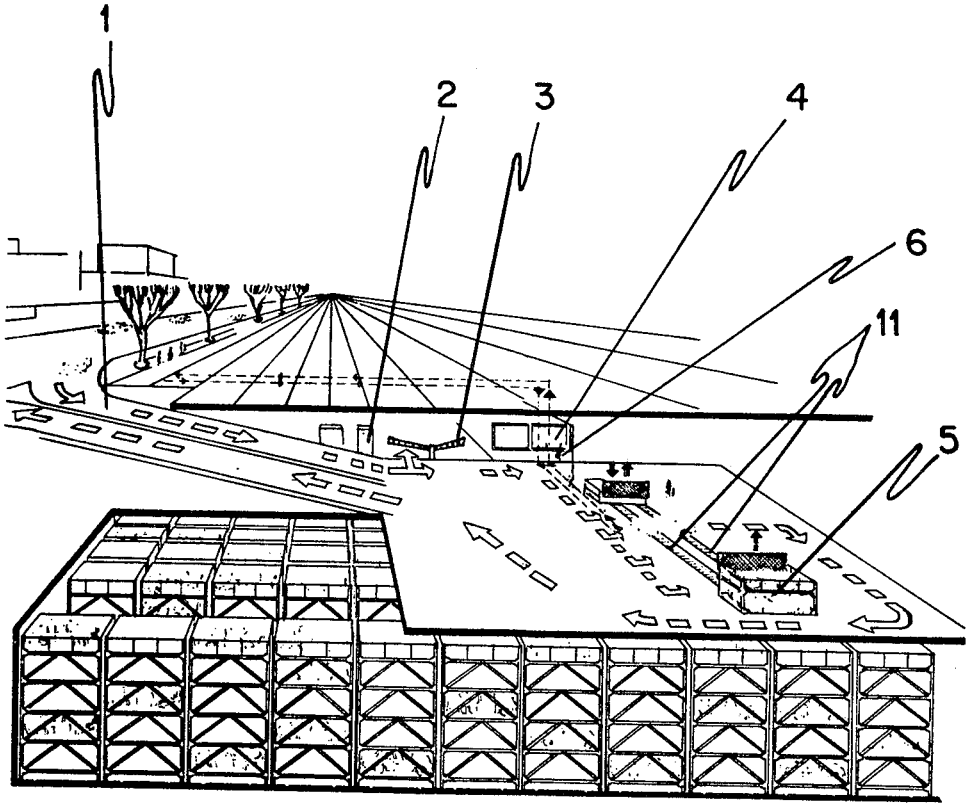
FIG. 1 is a partially sectioned perspective view of an underground parking system according to the present invention.

With reference to FIG. 1, the general functioning of the vehicle parking system of the invention will be described.

A vehicle enters the systems along lane 1 and passes to a zone 2 whereat a control means, such as a photoelectric cell or other suitable control, supplies a customary parking or time voucher ticket, and additionally may perform a control function to determine a specific area to which the vehicle will be taken for storage. Such addition control may be based, e.g., on the length of the vehicle.

A set of barriers 3 controlled by the control means at zone 2 will allow passage of the vehicle to an assigned parking lot area.

Parking of the vehicle is supervised at an area 4.

The vehicle is driven to and positioned on a vehicle aligning entrance or exit area 11 where it is abandoned by the driver. The vehicle is then automatically introduced into the parking area by means of the systems to be described below.

When the driver wishes to withdraw the vehicle from the parking area, the following will be carried out.

The driver presents the voucher or ticket to the cash desk 6, after which the vehicle is delivered to him automatically.

Functioning and the structure of the various elements forming the system of the invention will now be described, while assuming that a vehicle is at the entrance, that is when it has been placed on the aligning areas or zone 11 whereat the occupants abandon the vehicle.

The vehicle is moved to a cargo hoist 5 or elevator by the aligning areas and is transferred to the cargo hoist by a transfer carrige, to be described in detail below. When the cargo hoist moves the vehicle vertically to be aligned with a desired floor or story of a storage tower or column 9, to be described in detail below, the vehicle is transferred from the cargo hoist to the column by the transfer carriage.

A power carriage 10 is then moved to collect column 9 which has the vehicle introduced therein and to move column 9 to a desired storage site within the parking area.

The above sequence of operations is carried out in inverse order to remove the vehicle from the parking area.

The surfaces which support the vehicle in areas 11, in cargo hoist 5 and in column 9 are formed by a pair of series of spaced slats or strips 50, one series of strips 50 for the front wheels of the vehicle, and another series of strips 50 for the back wheels of the vehicle.

As shown in FIGS. 3–6, the transfer carriage is formed of a frame 12 supporting thereon groups of double wheels 13 and single wheels 14. Wheels 13 are provided as double wheels to permit alignment between the transferring zone the entrance and the cargo hoist or between the cargo hoist and the column.

The wheels of the transfer carriage ride on rails 15 on the transfer carriage. Rails 14 align with other rails on the tower floor or in areas 11. The frame 12 supports on opposite lateral sides thereof shovels each formed by plural spaced bars 16 which are introduced between the slats 50 when such shovels are displaced horizontally.

The shovels may be moved in a vertical direction by the operation of an electric motor 17 which activates a hydraulic pump 18 which raises the two shovels by means of hydraulic cylinders 19, which act on a supporting shaft 20 which supports the shovels.

The shovels are raised or lowered by an amount sufficient so that the bars 16 of the shovels move above or below the upper surface of the slats 50. The vehicle wheels, previously supported by slats 50, will rest on the bars 16 of the shovels when the shovels are raised so that the bars 16 pass through and above the slats 50.

The horizontal displacement of the shovels is achieved by a motor reducer 21 which drives wheels 14 along rails 15, thus carrying out the transference of the shovels, and thus of the vehicle from the floor of a column to the cargo hoist, or vice versa, or from the cargo hoist to the entrance, or vice versa.

A desired transferring level is reached by vertically raising or lowering the cargo hoist.

Figure 3:
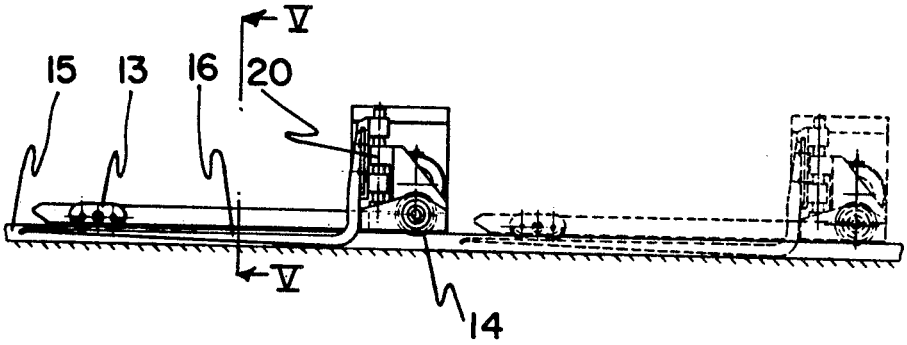
FIG. 3 is a side elevational view of the vehicle displacing device included in the system of FIG. 1.
Figure 5:
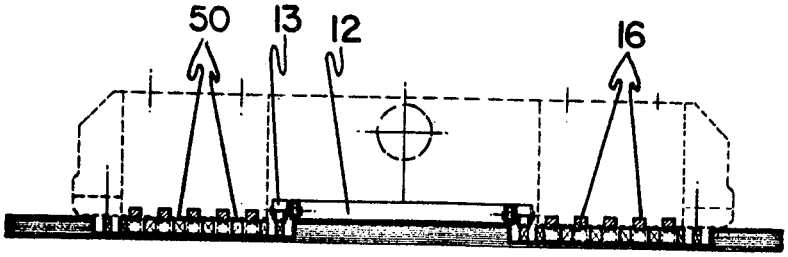
FIG. 5 is a section taken along line V—V in FIG. 3.
Figure 4:
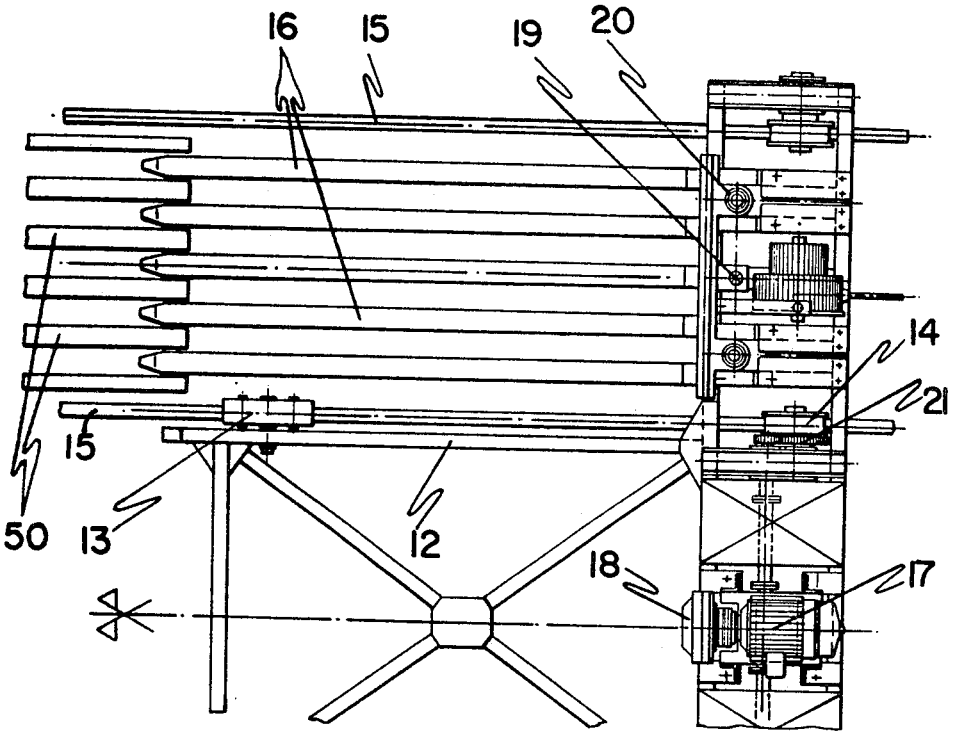
FIG. 4 is an upper plan view of the device of FIG. 3.

Once the vehicle is aligned with such transferring level, the motor reducer 21 is activated to cause horizontal movement of the shovels, e.g. from the dashed line position to the solid line position of FIG. 3.

While moving the vehicle horizontally, the shovels convey the vehicle at a level higher than that of slats 50. At the end of such movement, the shovels are lowered to a level lower than slats 50, thereby transferring the vehicle to slats 50, by reverse direction operation of the hydraulic cylinders 19.

Figure 2:
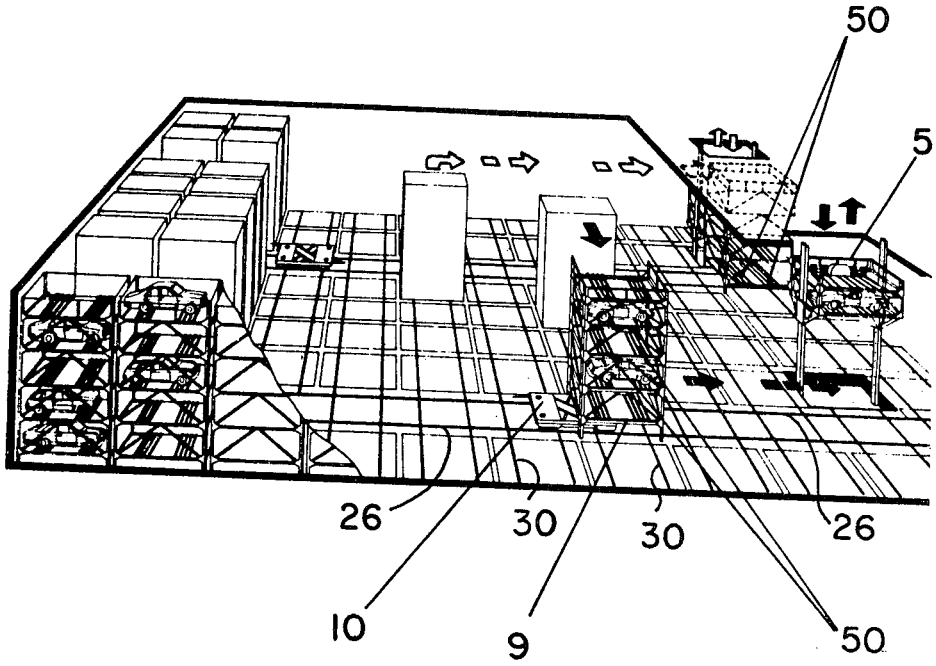
FIG. 2 is a perspective view of the underground area of the system of FIG. 1.

Under such conditions, the vehicle remains deposited on a floor of the column, as illustrated in FIGS. 1 and 2, or else at the entrance or collection zone of the system, as the case may be. The operating cycle of the transfer carriage is completed when the shovels are returned from the solid line position to the dashed line position of FIG. 3.

FIGS. 6A–6D schematically illustrate, although with exaggerated dimensions, the above described movements. FIGS. 6A–6D specifically relate to the transfer of a vehicle from a floor of a column 9 to a cargo hoist unit 5. The transfer carriage moves from the position shown in FIG. 6A in the cargo hoist unit 5 to the position shown in FIG. 6B on the column 9 with the bars 16 below the level of the slats 50 of the column.

Figures 6, 6A, 6B, 6C, 6D:
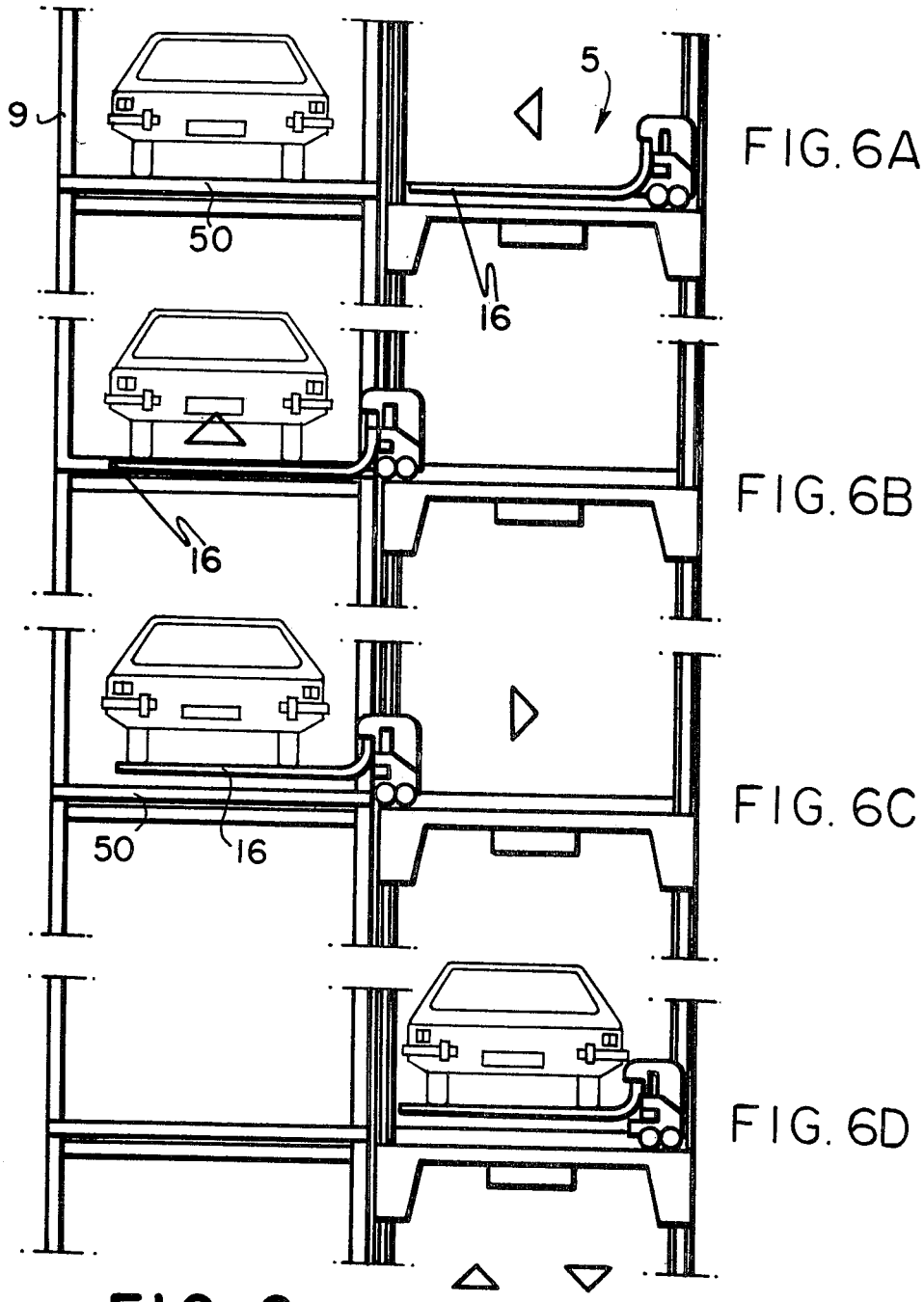
FIGS. 6A–6D are disgrammatic views illustrating the functioning of the device of FIGS. 3 through 5.
Figure 10:
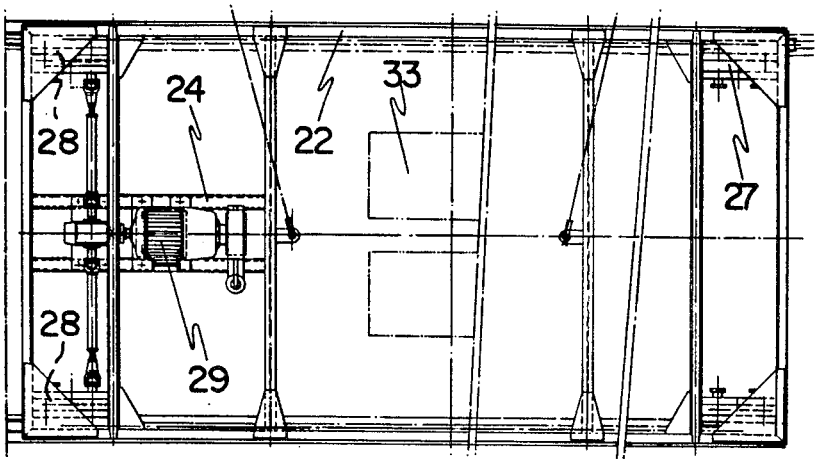
FIG. 10 is an upper plan view of a self-driving platform which forms a lower portion of the power carriage.

From the positions of FIGS. 6B to 6C, the shovels are raised so that bars 16 pass through slats 50 and support of the vehicle is transferred to the shovels.

From the positions of FIGS. 6C to 6D, the transfer carriage is returned to the cargo hoist unit 5, thereby transferring the vehicle from column 9 to cargo hoist unit 5.

Figure 8:
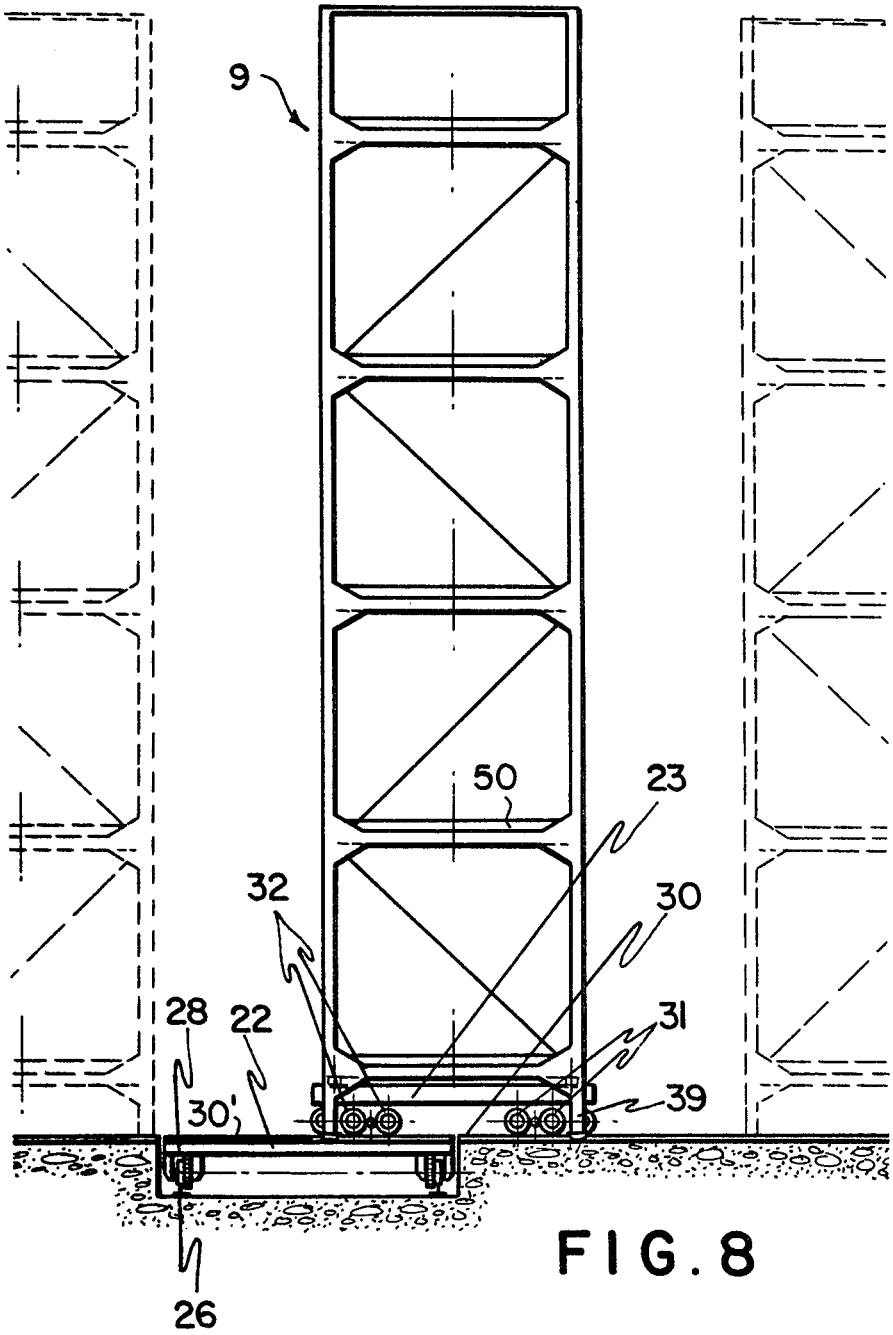
FIG. 8 is an enlarged elevational view of a column being transferred by means of the power carriage.
Figure 9:
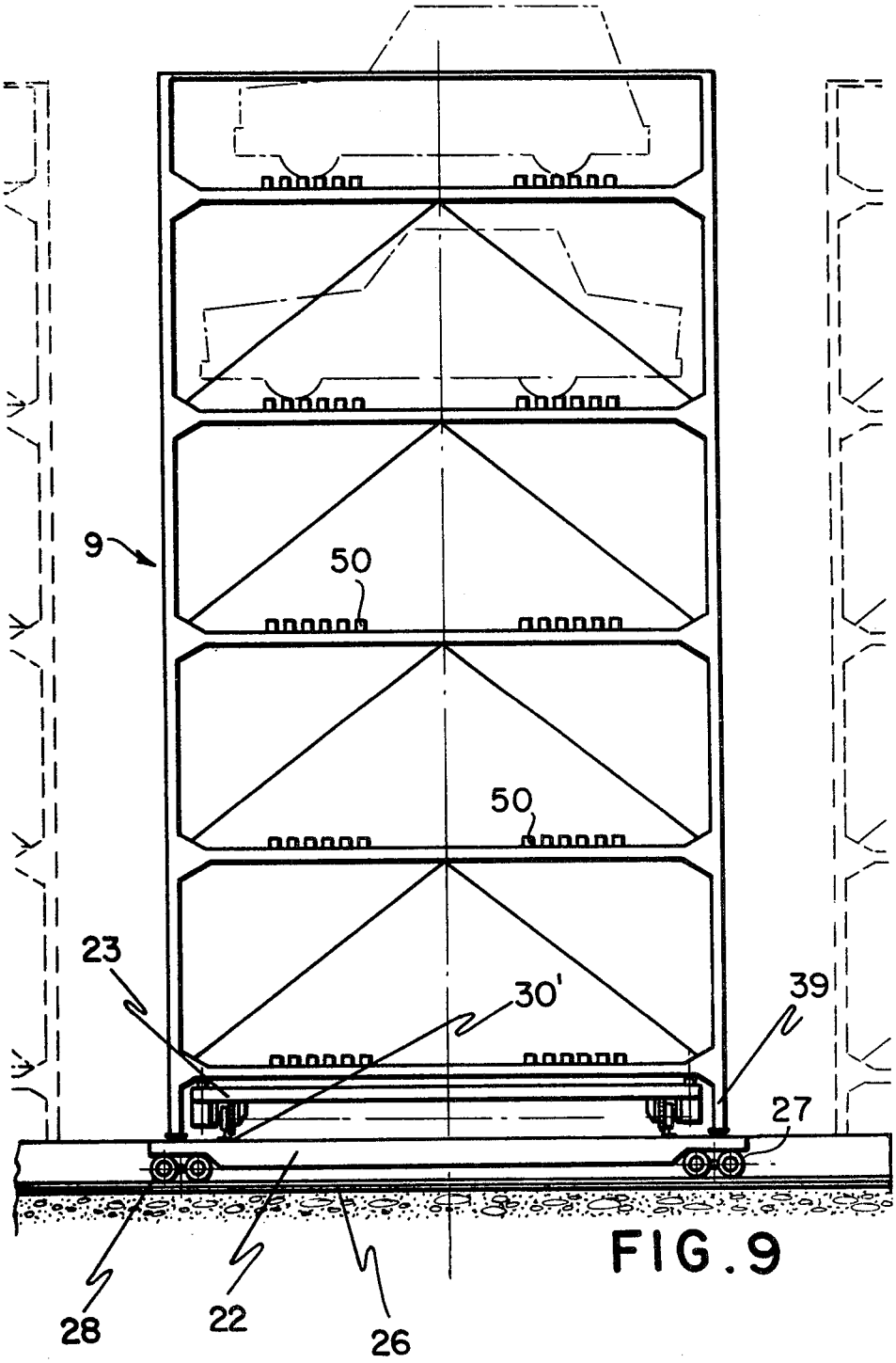
FIG. 9 is a side view of the column and power carriage shown in FIG. 8.
Figure 11:
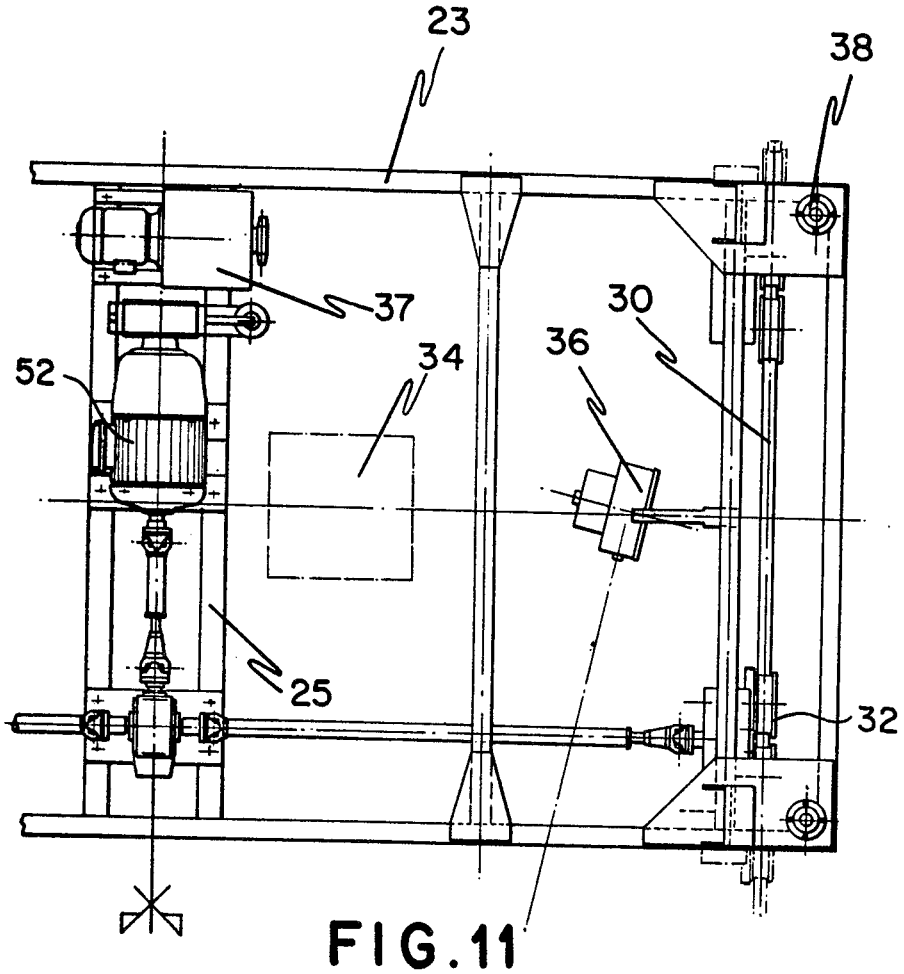
FIG. 11 is an upper plan view of a self-driving platform which forms an upper portion of the power carriage.

As can be seen particularly in FIGS. 8 and 9, each column 9 has therein a plurality, e.g. five, vertically spaced floors which define parking zones or areas for the vehicles.

The columns, which are exclusively metal structures and which lack any electrical or moving mechanical parts or elements, are lifted and moved by means of the power carriage systems illustrated in FIGS. 7 to 13.

The lower floor of each column 9 is separated from the ground level of the parking storage area by a sufficient distance to permit the introduction below the column of the upper platform of the power carriage.

This distance or separation is determined by the height of legs 39 of the column. The lower ends 52 of legs 39 are formed of a relatively soft material, such as bronze, to absorb possible impact on the ground of the parking area in the event of failure of the column raising system. Soft ends 51 would absorb any such impact, and scoring on or other damage to the ground by the structure of the column would be prevented. Such scoring would result in the ground having an uneven configuration, and could produce overturning of the columns.

Adjacent the corners of the bottom of the lower floor of each column, there are provided elements having concave recesses 44 which receive the heads of pistons or jacks 38 which raise the column.

The power carriage 10 according to the invention includes a lower part in the form of a self-driving platform 22 which is displaceable along tracks 26 in the longitudinal direction of the parking storage area. Lower platform 22 is complemented, at the top thereof, with an upper self-driving platform 23 which is displaceable along tracks 30 on the ground, as well as track lengths 30' on top of platform 22. Tracks 30' align with tracks 30, dependent on the position of platform 22, and extend in a direction transverse to that of tracks 26.

The two platforms 22 and 23 each have independent self-driving means to provide movement along the respective rails or tracks. This assembly of platforms forms the power carriage system. The platforms 22 and 23 each include mechanical elements and controls supported by corresponding frames or chassis elements 24 and 25, respectively.

The lower platform 22 is displaced along the continuous tracks 26 by a series of wheels 27, preferably eight wheels. The eight wheels are distributed in four pairs, of which two pairs 28 are driven by an electric motor 29.

The upper platform 23, due to the discontinuous nature of the tracks 30 and 30' thereof, is provided with four groups 31 of wheels, each group including three wheels. Two wheel groups 32 are driven, e.g. by motor 52, and the remaining groups are free-turning.

Figure 7:
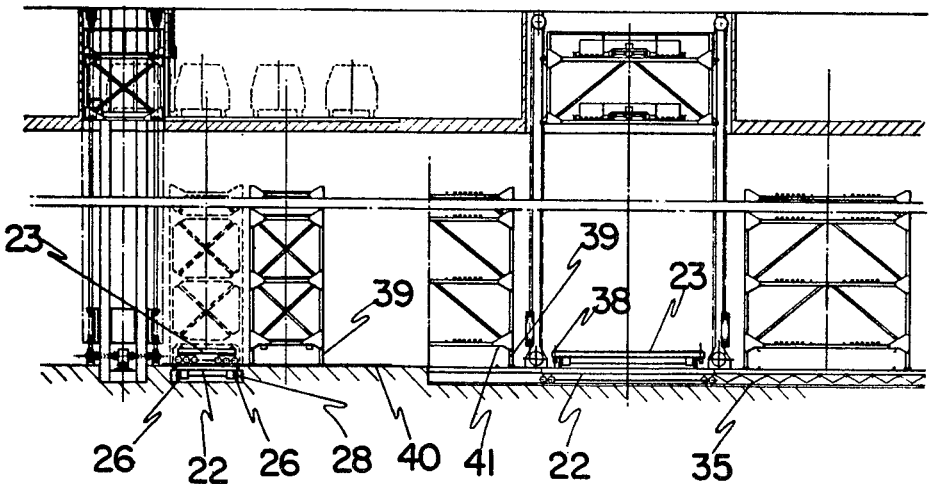
FIG. 7 is an elevational view, partially in section, of a portion of the underground area of FIG. 2, but also illustrating several vehicle storage columns, as well as the construction of a power carriage system for moving such columns within the area.

Respective driven wheels 28 and 32 are caused to be driven by respective motors 29 and 52, e.g. by signals from control boxes 33 and 34, respectively mounted on the platforms 22 and 23. Lower platform 22 may be provided with a current collector 35, of an extensible nature, as shown in FIG. 7.

Power to the upper platform 23 may be effected by means of a cable capable of being wound on a drum 36 mounted on the upper platform 23.

A hydraulic source 37 for activating telescopically extensible cylinders 38 is fixed to the upper platform 23.

The operation of the above assembly may be as follows.

The power carriage 10 including the two platforms 22 and 23 will be displaced until it is positioned adjacent a column. Then, the upper platform 23 advances from tracks 30' onto tracks 30 until it is situated below the column which is to be moved. Then, the telescopic hydraulic cylinders 38 supported on the upper platform 23 are actuated to raise the column 9 so that the legs 39 thereof will lose contact with the floor 40. Then, the upper platform 23 is returned onto the lower platform 22, simultaneously moving column 9.

Movement of the power carriage 10, including the two platforms one on top of the other, and furthermore bearing the column, will then be achieved by driving lower platform 22 along tracks 26.

Figure 14:
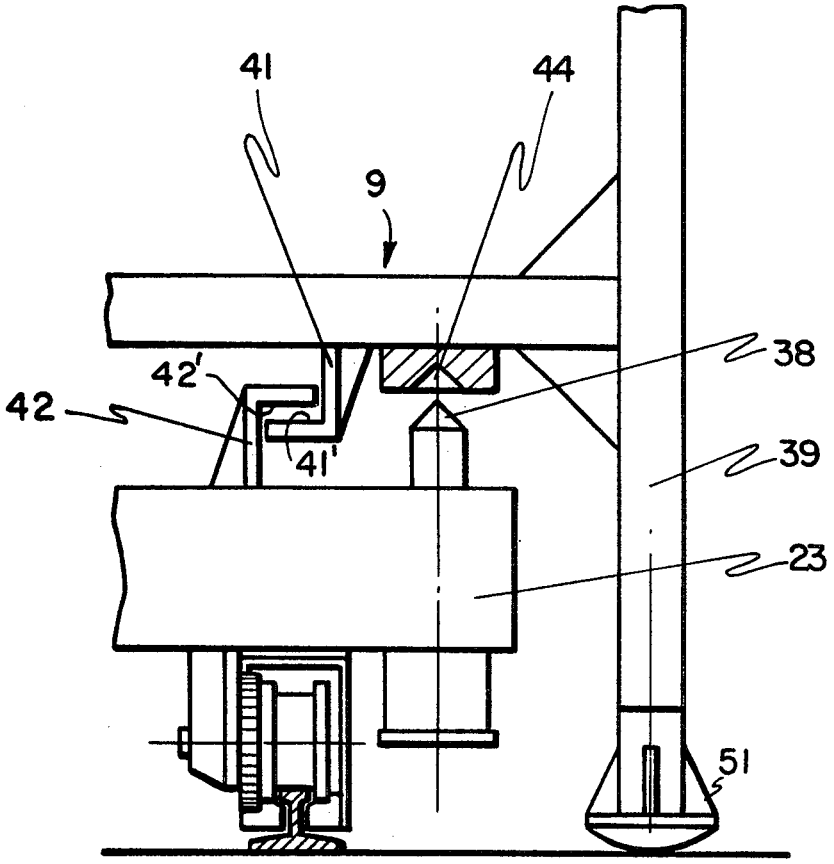
FIG. 14 is an enlarged detail view of a device for fastening the column to the upper platform of the power carriage.

A safety system may be provided to prevent the column from overturning, as particularly shown in FIG. 14. This system may include complementary flanged surfaces extending parallel to the direction of movement of upper platform 23 and provided on the lateral sides of the upper surface of platform 23 and the lower surface of the bottom floor of the column 9. As platform 23 moves to a position beneath the column, and thereafter when the platform is raised, the complementary surfaces on opposite sides of the platform 23 and raised column become engaged. This engagement prevents tilting and possible overturning of the column with respect to the upper platform.

As shown in FIG. 14, elongated flange 41 mounted on the bottom of the lower floor of column 9 has a surface 41' which complements a surface 42' of elongated flange 42 mounted on upper platform 23.

It is evident from FIG. 14, when the platform 23 slides under the column 9 and raises it, surfaces 41' and 42' engage. This engagement, occurring on opposite lateral sides of the column and platform, prevents relative tilting between the column and platform.

Figure 12:
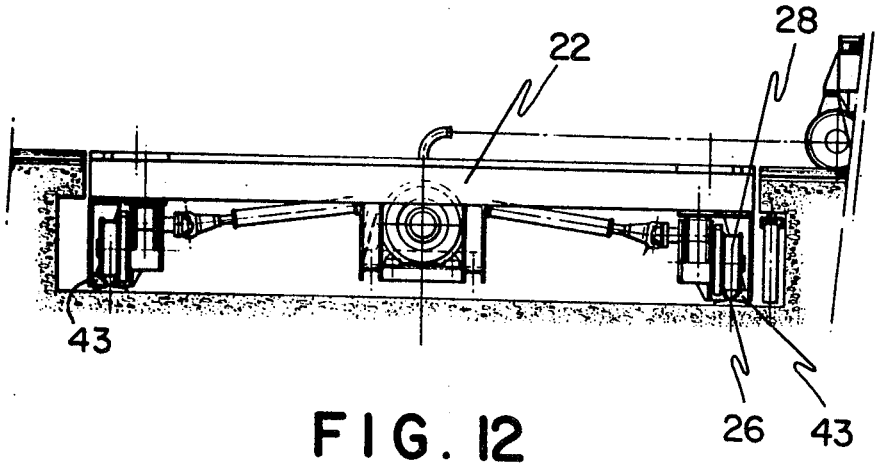
FIG. 12 is a side elevational view of the lower platform of FIG. 10.
Figure 13:
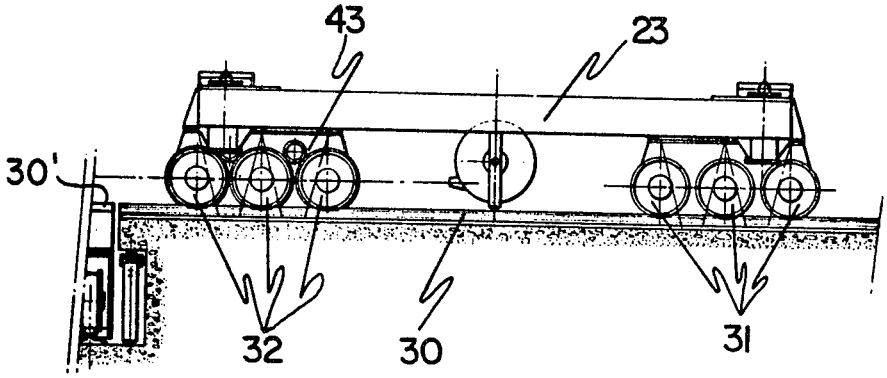
FIG. 13 is a side elevational view of the upper platform of FIG. 11.

To prevent overturning of the lower platform 22 with respect to the rails 26 when platform 22 supports thereon upper platform 23 and a column (loaded with vehicles or not), the arrangement shown in FIGS. 12 and 13 can be provided. Such arrangement includes clamps 43 which are fixed to the frame of the platform 22 and extend downwardly therefrom and which on the lower ends thereof have portions adapted to the profile of the rails 26. Thus, the clamps prevent lateral tilting of platform 22 relative to rails 26.

Clamps similar to clamps 43 may be provided on upper platform 23 to engage the rails 30' on lower platform 22.

Clamps 43 and complementary flanges 41 and 42 provide a degree of safety which prevents overturning of a column, particularly upon the initiation and termination of movement of the column.

Figure 15:
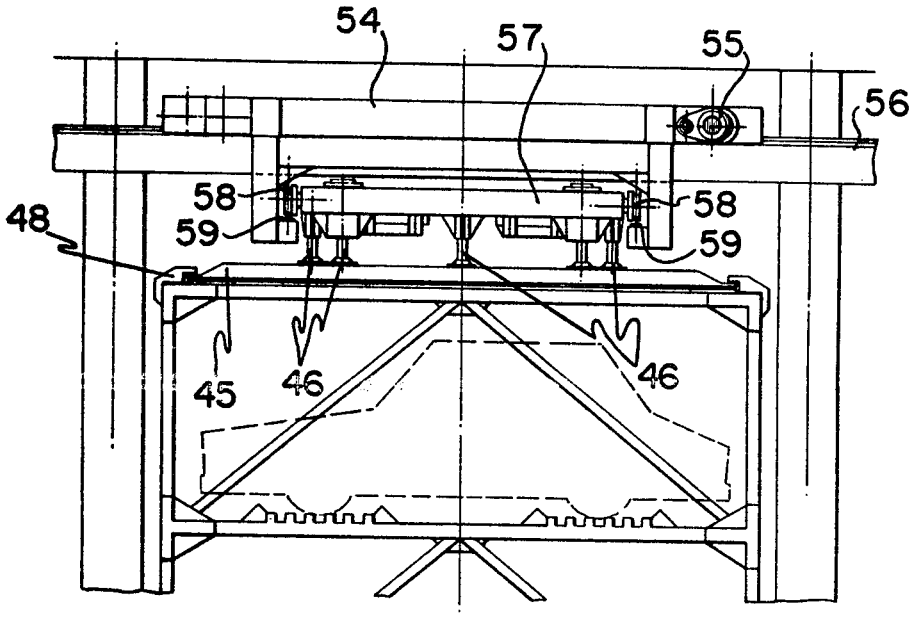
FIG. 15 is an elevational view of an optional device for moving a column by suspending the column from the upper portion thereof.
Figure 16:
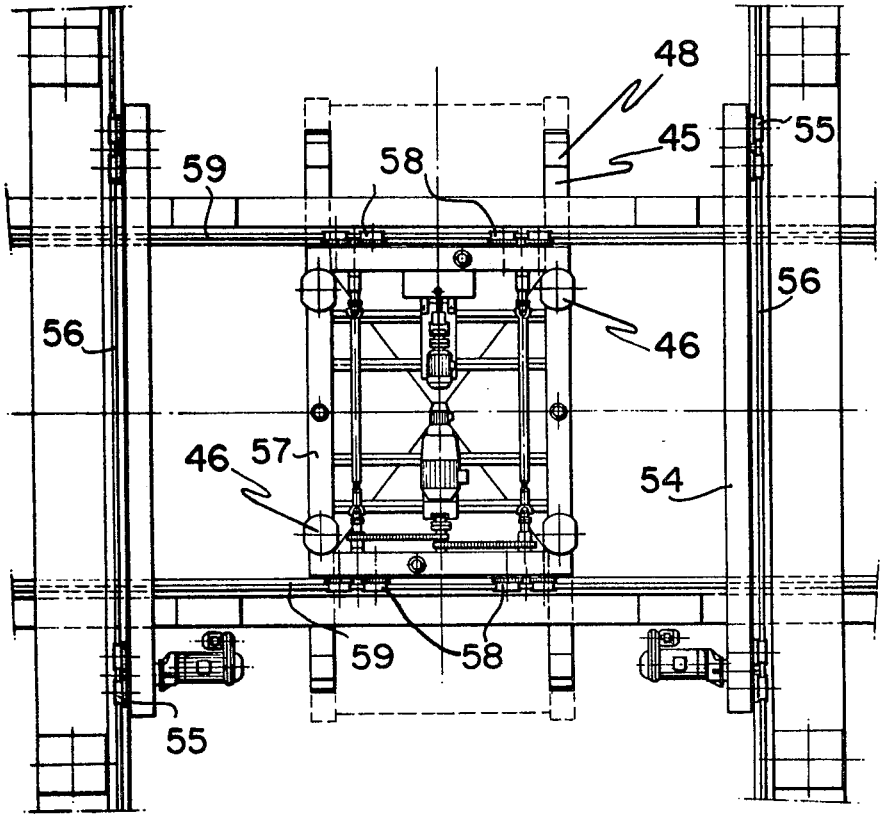
FIG. 16 is a plan view of the device illustrated in FIG. 15.

FIG. 15 and 16 illustrate generally the operation of a bridge crane, known per se, which may be provided in addition to or in place of power carriage 10 for moving a column 9.

If the need were to arise to effect the transport of the columns at their upper part, this bridge crane including three primary sub-assemblies, as shown in FIGS. 15 and 16, could be used.

A longitudinally displaceable bridge includes, in a generally known manner, a support 54 movable by wheels 55 over tracks 56.

A transverse displaceable carriage includes, in a generally known manner, a support 57 which is movable by wheels 58 along rails 59 mounted on support 54.

Displacements in the longitudinal and transverse directions will be readily understood from FIGS. 15 and 16, since such movements are basically conventional.

According to the invention, however, the bridge crane includes an arrangement to effect vertical movements, thus raising the column so that it then may be displaced, first by transverse displacement and second by longitudinal displacement.

The assembly for achieving vertical movement includes flanges 45 which grasp the column and which are supported by a plurality of hydraulic cylinders 46 which allow vertical displacement of flanges 45 and thus of the grasped column.

Flanges 45 will be situated below wings 48 which are located near to the upper corners of the column to be lifted. Thus, when the cylinders 46 are raised, the column will be suspended and raised, whereafter it may be transported.

The bridge crane mechanism just described has the following advantages compared with the power carriage 10:

(a) It is easier to supply electric command signals to the overhead bridge crane.

(b) The overhead bridge crane provides greater stability during transport of the columns.

(c) The overhead bridge crane is capable of greater speed in the transport of the columns.

(d) The use of the overhead bridge crane enables the structure of the column to be less sturdy.

The bridge crane mechanism has the following disadvantages compared with the power carriage 10:

(a) The use of the bridge crane makes it necessary to increase the height of the parking storage area, with the resultant increased cost.

(b) The risk in effecting repairs during breakdowns is greater with the bridge crane than with the power carriage.

(c) The cost of the bridge crane is greater than that of the power carriage.

It will be apparent that various modifications may be made to the above specifically described arrangements without departing from the scope of the invention.

I claim:

1. A vehicle parking system comprising:

a vehicle parking area having a floor and a ceiling;

a plurality of vehicle supporting columns within said vehicle parking area, each said column having a plurality of vertically aligned vehicle supporting floors, each said supporting floor being formed by a plurality of spaced parallel slats;

at least one vehicle entrance and exit area located above said ceiling of said parking area, said entrance and exit area being defined by a plurality of spaced parallel slats;

at least one cargo hoist unit supported in a fixed horizontal position on said floor of said parking area, said cargo hoist unit having at least one vertically movable elevator means, selectively alignable with said entrance and exit area and said floors of said columns, for vertically moving vehicles between said entrance and exit area and selected column floor levels;

transfer carriage means, mounted on said cargo hoist unit elevator means, for transferring a vehicle between said entrance and exit area and said cargo hoist unit and between said cargo hoist unit and a selected floor of a column positioned adjacent said cargo hoist unit, said transfer carriage comprising a frame, a plurality of spaced parallel bars supported by said frame, means for moving said bars horizontally between said cargo hoist unit and said entrance and exit area or a selected column floor, said bars being dimensioned to fit between said spaced slats of said entrance and exit area or said selected column floor, and means for moving said bars vertically between said spaced slats to pick up a vehicle from or deposit a vehicle on said entrance and exit area or said selected column floor;

means, positioned within said parking area, for horizontally moving selected of said columns between a position confronting said cargo hoist unit and selected storage positions within said parking area, said column moving means comprising a first plurality of parallel tracks extending in a first direction on said parking area floor, a lower platform movable along said first tracks, a second plurality of tracks extending in directions transverse to said first tracks, said second tracks comprising first track portions on said parking area floor and second track portions on the top of said lower platform and alignable with said first track portions, an upper platform movable along said second tracks between a position above and supported on said lower platform and a position beneath a selected said column, and means on said upper platform for vertically lifting and supporting said selected column when said upper platform is positioned thereunder, whereby when said upper platform then moves to a position above said lower platform, said selected column and said upper platform are supported by said lower platform; and means for preventing tilting of said supported column with respect to said upper platform, said tilt preventing means comprising first elongated flanges on said column, second elongated flanges on said upper platform, said first and second flanges extending in directions parallel to said second tracks, said first and second flanges having surfaces which press against each other when said column tilting means are raised.

2. A system as claimed in claim 1, further comprising means for preventing tilting of said lower platform with respect to said first tracks.

3. A system as claimed in claim 2, wherein said tilt preventing means comprises clamps attached to and extending downwardly from opposite lateral sides of said lower platform, said clamps having lower portions engaging with said first tracks.

4. A vehicle parking system comprising:

a vehicle parking area having a floor and a ceiling;

a plurality of vehicle supporting columns within said vehicle parking area, each said column having a plurality of vertically aligned vehicle supporting floors, each said supporting floor being formed by a plurality of spaced parallel slats;

at least one vehicle entrance and exit area located above said ceiling of said parking area, said entrance and exit area being defined by a plurality of spaced parallel slats;

at least one cargo hoist unit supported in a fixed horizontal position on said floor of said parking area, said cargo hoist unit having at least one vertically movable elevator means, selectively alignable with said entrance and exit area and said floors of said columns, for vertically moving vehicles between said entrance and exit area and selected column floor levels;

transfer carriage means, mounted on said cargo hoist unit elevator means, for transferring a vehicle between said entrance and exit area and said cargo hoist unit and between said cargo hoist unit and a selected floor of a column positioned adjacent said cargo hoist unit, said transfer carriage comprising a frame, a plurality of spaced parallel bars supported by said frame, means for moving said bars horizontally between said cargo hoist unit and said entrance and exit area or a selected column floor, said bars being dimensioned to fit between said spaced slats of said entrance and exit area or said selected column floor, and means for moving said bars vertically between said spaced slats to pick up a vehicle from or deposit a vehicle on said entrance and exit area or said selected column floor; and means, positioned within said parking area, for horizontally moving selected of said columns between a position confronting said cargo hoist unit and selected storage positions within said parking area, said column moving means comprising a first plurality of parallel tracks extending in a first direction on said parking area floor, a lower platform movable along said first tracks, a second plurality of tracks extending in directions transverse to said first tracks, said second tracks comprising first track portions on said parking area floor and second track portions on the top of said lower platform and alignable with said first track portions, an upper platform movable along said second tracks between a position above and supported on said lower platform and a position beneath a selected said column, and means on said upper platform for vertically lifting and supporting said selected column when said upper platform is positioned thereunder, whereby when said upper platform then moves to a position above said lower platform, said selected column and said upper platform are supported by said lower platform, said column lifting means comprising vertically movable jacks, and concave elements on said column to receive said jacks.

5. A system as claimed in claim 4, further comprising means for preventing tilting of said supported column with respect to said upper platform.

6. A system as claimed in claim 5, wherein said tilt preventing means comprises first elongated flanges on said column, second elongated flanges on said upper platform, said first and second flanges extending in directions parallel to said second tracks, said first and second flanges having surfaces which press against each other when said column tilting means are raised.

7. A system as claimed in claim 4, further comprising means for preventing tilting of said lower platform with respect to said first tracks.

8. A system as claimed in claim 7, wherein said tilt preventing means comprises clamps attached to and extending downwardly from opposite lateral sides of said lower platform, said clamps having lower portions engaging with said first tracks.

9. A system as claimed in claim 4, wherein each said column has supporting legs, the lower end of each of which is formed of a relatively soft shock absorbing material.

* * * * *